US009734786B2

(12) United States Patent
Park et al.

(10) Patent No.: US 9,734,786 B2
(45) Date of Patent: Aug. 15, 2017

(54) SOURCE DRIVE INTEGRATED CIRCUIT AND DISPLAY DEVICE INCLUDING THE SAME

(71) Applicant: SAMSUNG DISPLAY CO., LTD., Yongin, Gyeonggi-Do (KR)

(72) Inventors: Kyong-Tae Park, Yongin (KR); Seong-Yeun Kang, Yongin (KR); Jung-Hoon Kim, Yongin (KR); Tae-Gon Kim, Yongin (KR); Dong-Yoon So, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 131 days.

(21) Appl. No.: 14/705,139

(22) Filed: May 6, 2015

(65) Prior Publication Data

US 2016/0086563 A1 Mar. 24, 2016

(30) Foreign Application Priority Data

Sep. 23, 2014 (KR) ..... 10-2014-0126849

(51) Int. Cl.

| | |
|---|---|
| ***G09G 3/36*** | (2006.01) |
| ***G09G 5/18*** | (2006.01) |
| ***G09G 3/3275*** | (2016.01) |

(52) U.S. Cl.

CPC ..... *G09G 3/3696* (2013.01); *G09G 3/3275* (2013.01); *G09G 3/3648* (2013.01); *G09G 3/3685* (2013.01); *G09G 5/18* (2013.01); *G09G 2300/0426* (2013.01); *G09G 2310/0275* (2013.01); *G09G 2330/021* (2013.01); *G09G 2330/04* (2013.01); *G09G 2330/08* (2013.01); *G09G 2330/12* (2013.01)

(58) Field of Classification Search

None

See application file for complete search history.

(56) References Cited

U.S. PATENT DOCUMENTS

| | | | |
|---|---|---|---|
| 2010/0232077 | A1 | 9/2010 | Worley |
| 2011/0169813 | A1 | 7/2011 | Jin et al. |

(Continued)

FOREIGN PATENT DOCUMENTS

| | | | |
|---|---|---|---|
| KR | 10-2013-0005096 | A | 1/2013 |
| KR | 10-2013-0143335 | A | 12/2013 |

(Continued)

OTHER PUBLICATIONS

Extended European Search Report dated Feb. 19, 2016 in Corresponding European Patent Application No. 15183373.8.

*Primary Examiner* — Nicholas Lee
*Assistant Examiner* — Duane N Taylor, Jr.
(74) *Attorney, Agent, or Firm* — Lee & Morse P.C.

(57) ABSTRACT

A source drive integrated circuit includes a source driving circuit, output buffers, and voltage protection circuits. The source driving circuit generates data voltages according to a source timing control signal and digital video data. The output buffers output the data voltages from the source driving circuit to output terminals. The voltage protection circuits are connected between the output buffers and the output terminals. A voltage supplied to at least one of the voltage protection circuits is different from a voltage supplied to remaining ones of the voltage protection circuits.

20 Claims, 10 Drawing Sheets

(56) References Cited

U.S. PATENT DOCUMENTS

| | | | | |
|---|---|---|---|---|
| 2012/0032942 | A1 | 2/2012 | Toyotaka et al. | |
| 2013/0009931 | A1 | 1/2013 | Yeo et al. | |
| 2014/0028650 | A1 | 1/2014 | Bae | |
| 2014/0313114 | A1* | 10/2014 | Ahn | G09G 3/3677 345/92 |

FOREIGN PATENT DOCUMENTS

| | | | |
|---|---|---|---|
| KR | 10-2014-0013719 | A | 2/2014 |
| KR | 10-2014-0015887 | A | 2/2014 |
| KR | 10-2014-0018961 | A | 2/2014 |

* cited by examiner

SOURCE DRIVE INTEGRATED CIRCUIT AND DISPLAY DEVICE INCLUDING THE SAME

CROSS-REFERENCE TO RELATED APPLICATION

Korean Patent Application No. 10-2014-0126849, filed on Sep. 23, 2014, and entitled, "Source Drive Integrated Circuit and Display Device Including the Same," is incorporated by reference herein in its entirety.

BACKGROUND

1. Field

One or more embodiments described herein relate to a source drive integrated circuit and a display device including a source drive integrated circuit.

2. Description of the Related Art

A variety of display devices have been developed. Examples include liquid crystal displays, organic light emitting diode displays, and electrophoretic displays. These displays are lighter in weight and smaller in volume than conventional cathode ray tube displays.

A display device generally includes a display panel having data lines, scan lines, and pixels, and a display panel driving circuit for driving the display panel. The display panel driving circuit may include a scan driving circuit connected to the scan lines for supplying scan signals, and a plurality of source drive integrated circuits connected to the data lines for supplying data signals.

In one type of device, a number of pads are located at one end of the display panel. These pads include signal pads, driving voltage pads, and power voltage pads. Driving voltage supply lines for supplying the driving voltages from the driving voltage pads to the scan driving circuit may be formed to cross the source drive ICs. In this case, the driving voltage supply lines may cross a line connected to a corresponding pad of the source drive IC. As a result, a defect may occur where a driving voltage supply line and the line connected to the pad of the source drive IC is short-circuited. When this occurs, the driving voltage supplied to the corresponding driving voltage supply lines may be adversely affected.

SUMMARY

In accordance with one embodiment, a source drive integrated circuit includes a source driving circuit to generate data voltages according to a source timing control signal and digital video data; output buffers to output the data voltages from the source driving circuit to output terminals; and voltage protection circuits connected between the output buffers and the output terminals, wherein a voltage supplied to at least one of the voltage protection circuits is different from a voltage supplied to remaining ones of the voltage protection circuits.

Each of the voltage protection circuits may include first and second diodes. A voltage supplied to the first diode of at least one of the voltage protection circuits may be different from a voltage supplied to the first diode of remaining ones of the voltage protection circuits. A voltage supplied to the second diode of at least one of the voltage protection circuits may be different from a voltage supplied to the second diode of remaining ones of the voltage protection circuits.

Each of the remaining ones of the voltage protection circuits may include first and second diodes, and the at least one voltage protection circuit may include the first diode. A voltage supplied to the first diode of at least one of the voltage protection circuits may be different from a voltage supplied to the first diode of remaining ones of the voltage protection circuits.

Each of the remaining voltage protection circuits may include first and second diodes, and the at least one voltage protection circuits may include the second diode. A voltage supplied to the second diode of at least one of the voltage protection circuits may be different from a voltage supplied to the second diode of the remaining ones of the voltage protection circuits.

In accordance with another embodiment, a display device includes a display panel including pixels at crossing regions of data lines and scan lines; one or more source drive Integrated Circuits (ICs) to supply data voltages to the data lines; and a scan driving circuit to supply scan signals to the scan lines, wherein the source drive IC includes: a source driving circuit to generate data voltages according to a source timing control signal and digital video data; output buffers to output the data voltages from the source driving circuit to output terminals; and voltage protection circuits connected between the output buffers and the output terminals, and a voltage supplied to at least one of the voltage protection circuits is different from a voltage supplied to remaining ones of the voltage protection circuits.

Each of the voltage protection circuits may include first and second diodes. A voltage supplied to the first diode of at least one of the voltage protection circuits may be different from a voltage supplied to the first diode of remaining ones of the voltage protection circuits. A voltage supplied to the second diode of at least one of the voltage protection circuits may be different from a voltage supplied to the second diode of remaining ones of the voltage protection circuits.

Each of the remaining ones of the voltage protection circuits may include first and second diodes, and the at least one voltage protection circuit may include the first diode. A voltage supplied to the first diode of at least one of the voltage protection circuits may be different from a voltage supplied to the first diode of the remaining ones of the voltage protection circuits.

Each of the remaining ones of the voltage protection circuits may include first and second diodes, and the at least one of the voltage protection circuits may include the second diode. A voltage supplied to the second diode of at least one of the voltage protection circuits may be different from a voltage supplied to the second diode of the remaining ones of the voltage protection circuits.

The display panel may include driving voltage pads, a test pad, and a test output pad; driving voltage lines to connect the driving voltage pads and the scan driver; and a test voltage line to connect the test pad and the test output pad, wherein the driving voltage lines and the test voltage line cross each other. The source drive IC may be on the driving voltage lines. The source drive IC may be attached to the display panel by a chip-on-glass connection or a chip-on-plastic connection.

The display panel may include signal supply pads; source input pads connected to input terminals of the source drive IC; signal input supply lines to connect the source input pads and the signal supply pads; and source output pads connected to output terminals of the source drive IC, and connected to the data lines.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
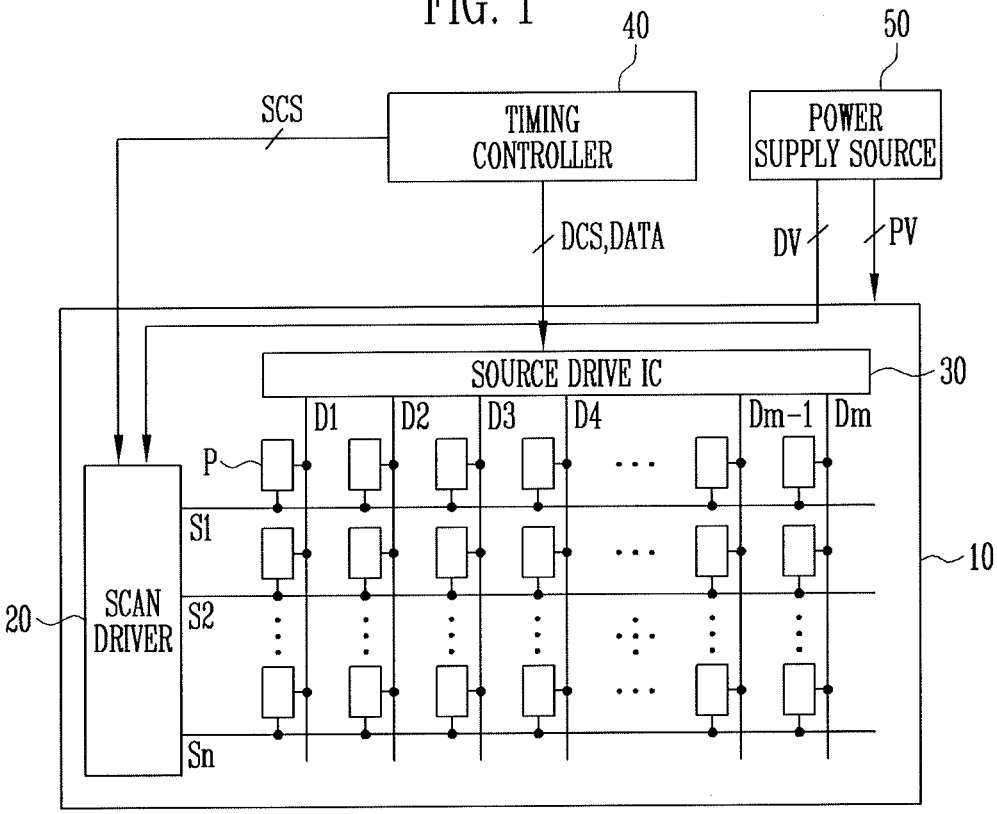
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

FIG. 1 illustrates an embodiment of a display device which includes a display panel 10, a scan driver 20, a source drive integrated Circuit (IC) 30, a timing controller 40, a power supply source 50, and the like.

The display panel 10 includes pixels P, and data lines D1 to Dm (m is a positive integer equal to or greater than 2) and scan lines S1 to Sn (n is a positive integer equal to or greater than 2) that cross each other. The pixels P are at respective intersections of the data lines D1 to Dm and the scan lines S1 to Sn. The pixels P are arranged in a matrix. Each pixel P is connected to a corresponding scan line and data line. Each pixel receives a data voltage from a corresponding data line when a scan signal is supplied from a corresponding scan line. The pixel P emits light with predetermined brightness according to a data voltage.

The display panel 10 includes a display area including the pixels P and a non-display area outside the display area. Examples of the display area and the non-display area will be described with reference to FIG. 3.

The scan driver 20 receives a scan timing control signal SCS from the timing controller 40. The scan driver 20 supplies scan signals to the scan lines S1 to Sn based on the scan timing control signal SCS. The scan driver 20 may sequentially supply the scan signals to the scan lines S1 to Sn. The scan driver 20 may be in the non-display area of the display panel 10 and, for example, may be provided in an Amorphous Silicon TFT gate driver scheme or a Gate Driver In Panel (GIP) scheme.

The source drive IC 30 receives digital video data DATA and a data timing control signal DCS from the timing controller 40. The source drive IC 30 converts the digital video data DATA to analog data voltages based on the data timing control signal DCS. The source drive IC 30 synchronizes the scan signals and the data voltages, respectively, and supplies the synchronized data voltages to the data lines D1 to Dm. Accordingly, the data voltages are supplied to the display pixels DPs, to which the scan signal is supplied.

The source drive IC 30 may be attached to the non-display area of the display panel 10, for example, by a chip-on-glass process or a chip-on-plastic process. For illustrative purposes, one source drive IC 30 is illustrated in FIG. 1. In another embodiment, a plurality of source drive ICs may be included.

The timing controller 40 receives the digital video data DATA and timing signals, for example, from a host system. The timing signals may include a vertical sync signal, a horizontal sync signal, a data enable signal, and a dot clock. A different combination of timing signals may be included in another embodiment.

The timing controller 40 generates the timing control signals for controlling operation timing of the scan driver 20 and the source drive IC 30 based on the timing signals. The timing control signals includes the scan timing control signal SCS for controlling an operation timing of the scan driver 20, and the data timing control signal DCS for controlling the operation timing of the source drive IC 30. The timing controller 40 outputs the scan timing control signal SCS to the scan driver 30, and outputs the data timing control signal DCS and the digital video data DATA to the source drive IC 30.

The power supply source 50 supplies driving voltages DV to the scan driver 20. The driving voltages DVs may include a gate on voltage for turning on transistors of the scan driver and a gate off voltage for turning off the transistors of the scan driver. Further, the power supply source 50 may supply power voltages PVs for driving the display panel 10 to the display panel 10. Further, the power supply source 50 may supply gamma voltages to the source drive IC 30.

Figure 2:
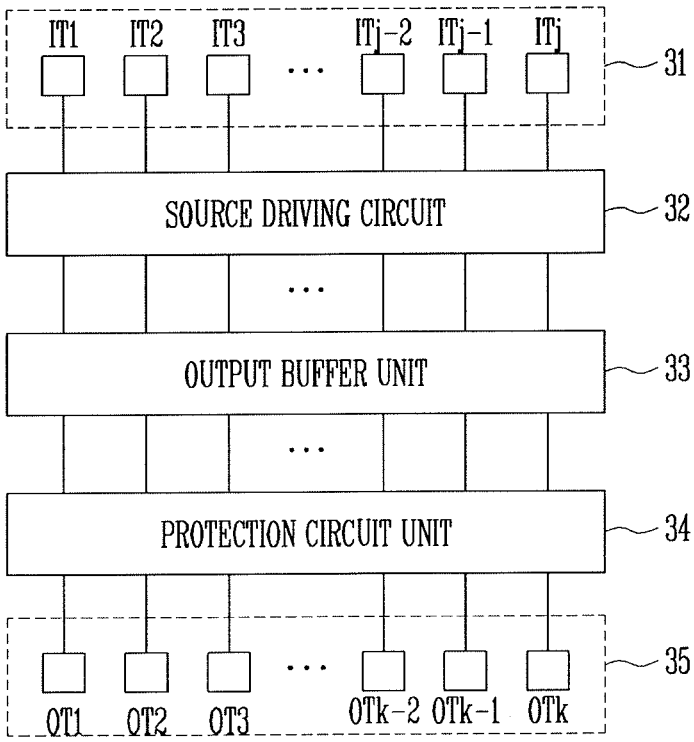
FIG. 2 illustrates an embodiment of a source drive IC.

FIG. 2 illustrates an embodiment of the source drive IC 30 in FIG. 1. Referring to FIG. 2, the source drive IC 30 includes input terminals 31, a source driving circuit 32, an output buffer unit 33, a protection circuit unit 34, and output terminals 35. The input terminals 31 may include first to jth input terminals (IT1 to ITj, j is a positive integer satisfying $2 \leq j \leq m$), and the output terminals 35 may include first to kth input terminals (OT1 to OTj, k is a positive integer satisfying $2 \leq k \leq n$).

The source driving circuit 32 receives the data timing control signal DCS and the digital video data DATA through the input terminals 31. The source drive IC 32 converts the digital video data DATA to analog data voltages according to the data timing control signal DCS. The source driving circuit 32 may include, for example, a shift register, a latch, and a digital analog converting circuit. The source driving circuit 32 outputs the analog data voltages DV to the output buffer unit 33.

The output buffer unit 33 outputs the analog data voltages DV through the output terminals 35. The output terminals 35 are connected to the data lines through the output pads. In order to prevent the output buffer unit 33 from being damaged due to static electricity, the protection circuit unit 34 may be connected between the output buffer unit 33 and the output terminals 35, as illustrated in FIG. 2.

Figure 3:
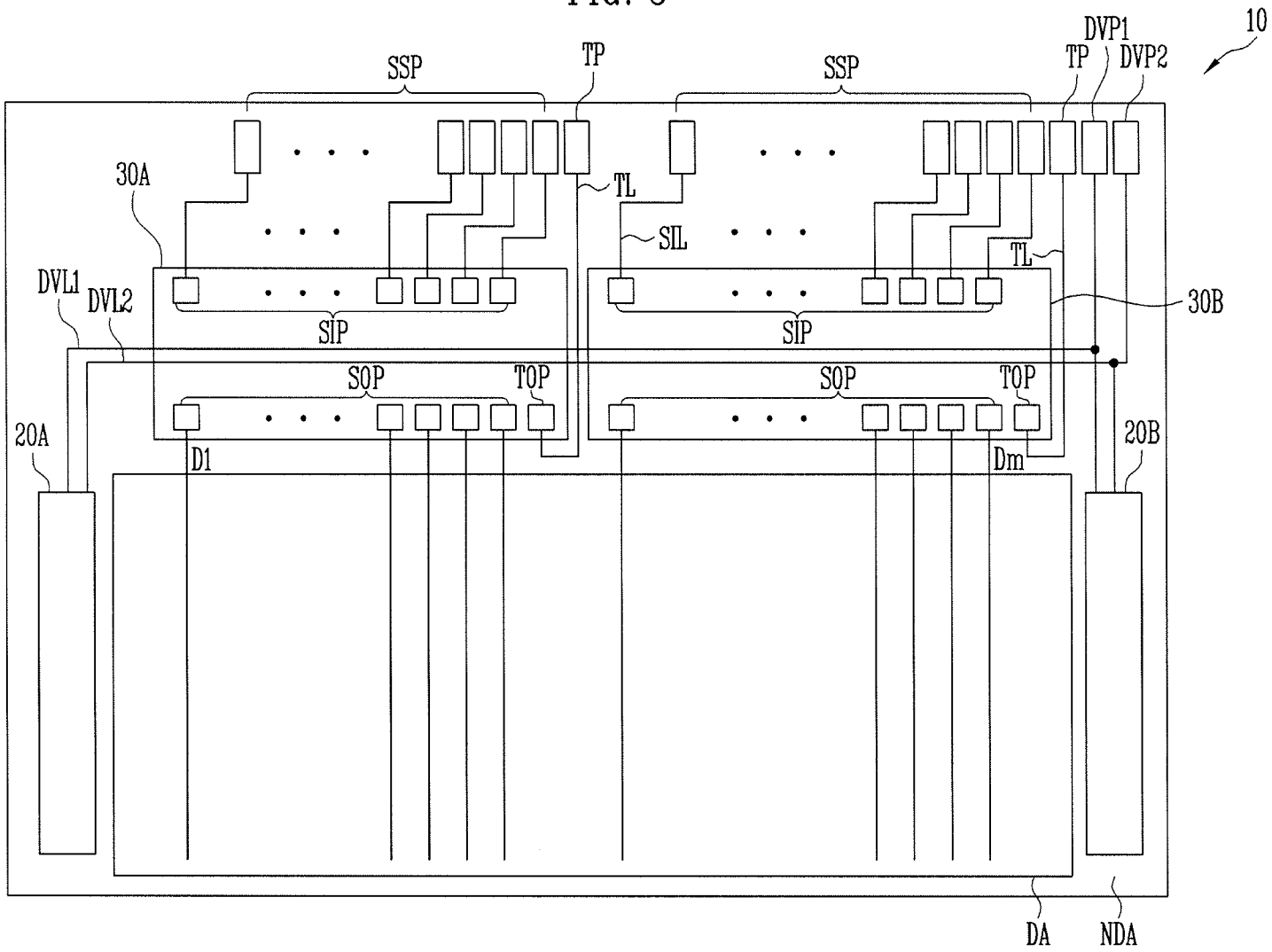
FIG. 3 illustrates an embodiment of a display panel and source drive ICs.

FIG. 3 illustrates an embodiment including the display panel 10 and the source drive ICs in FIG. 1. Referring to FIG. 3, the display panel 10 includes a display area DA including pixels P for displaying an image and a non-display area NDA outside the display area DA. The data lines D1 to Dm, and the scan lines S1 to Sn cross each other in the display area DA. The pixels P are at regions where the data lines D1 to Dm cross the scan lines S1 to Sn.

The non-display area NDA includes scan drivers, source drive ICs, and a plurality of pads. For illustrative purposes only, in FIG. 3, the display device is illustrated to include two scan drivers 20A and 20B and two source drive ICs 30A and 30B.

The scan drivers 20A and 20B may be at left and right lateral sides of the display area DA. In another embodiment, the scan drivers 20A and 20B may be at different locations. The scan drivers 20A and 20B receive driving voltages from driving voltage supply lines DVL1 and DVL2. The scan drivers 20A and 20B are connected to the scan lines S1 to Sn and output scan signals to the scan lines S1 to Sn.

The source drive ICs 30A and 30B may be at one lateral surface between upper and lower lateral surfaces of the display area DA. In another embodiment, the source drive ICs 30A and 30B may be at different locations, e.g., at the upper lateral surface of the display area DA or another location. Each of the source drive ICs 30A and 30B is connected to the source output pads SOP, and outputs the data voltages to the data lines D1 to Dm through the source output pads SOP.

Source input pads SIPs, the source output pads SOPs, signal supply pads SSPs, driving voltage pads DVP1 and DVP2, test pads TPs, and test output pads TOPs are formed on the display panel 10.

The source input pads SIPs are connected to input terminals of the source drive ICs 30A and 30B. The source input pads SIPs are connected to the signal supply pads SSPs through source input supply lines SILs. In this case, the source input pads SIP may be connected to the source input supply lines SILs, respectively, and the signal supply pads SSPs may be connected to the signal input supply lines SILs, respectively.

The source output pads SOPs are connected to output terminals of the source drive ICs 30A and 30B. The source output pads SOPs may be connected to the output terminals of the source drive ICs 30A and 30B, respectively. Further, the source output pads SOPs are connected to the data lines D1 to Dm. In one embodiment, each of the source output pads SOPs is connected to a respective one of the data lines D1 to Dm.

The driving voltage pads DVP1 and DVP2 are connected to the driving voltage supply lines DVL1 and DVL2. For example, a first driving voltage pad DVP1 is connected to a first driving voltage supply line DVL1, and the first driving voltage supply line DVL1 is connected to the scan drivers 20A and 20B. Accordingly, the first driving voltage supplied to the first driving voltage pad DVP1 is supplied to the scan drivers 20A and 20B. Further, a second driving voltage pad DVP2 is connected to a second driving voltage supply line DVL2, and the second driving voltage supply line DVL2 is connected to the scan drivers 20A and 20B. Accordingly, the second driving voltage supplied to the second driving voltage pad DVP2 is supplied to the scan drivers 20A and 20B.

A flexible film may be attached to the signal supply pads SSPs and the driving voltage pads DVP1 and DVP2.

The test output pads TOPs are connected to test voltage output terminals of the source drive ICs 30A and 30B. The test output pads TOPs are connected to test voltage lines TLs, and the test voltage lines TLs are connected to the test pads TPs. Accordingly, test voltages supplied to the test output pads TOPs are supplied to the test pads TPs. In one embodiment, test zigs are connected to the test pads TPs for measuring the test voltages.

Further, the source drive ICs 30A and 30B may be attached onto the driving voltage supply lines DVL1 and DVL2. The driving voltage supply lines DVL1 and DVL2 may be connected to the scan driver 20, while crossing the source drive ICs 30A and 30B. As a result, the driving voltage supply lines DVL1 and DVL2 cross only the test voltage lines TLs. Consequently, there is a possibility that the driving voltage supply lines DVL1 and DVL2 and the test voltage lines TLs may be short-circuited.

In one embodiment, the protection circuits are formed as illustrated in FIGS. 5 to 11. When formed in this manner, even if a short circuit forms between the driving voltage supply lines DVL1 and DVL2 and the test voltage lines TLs, voltage levels of the driving voltages supplied to the driving voltage supply lines DVL1 and DVL2 are not varied or adversely affected.

Figure 4:
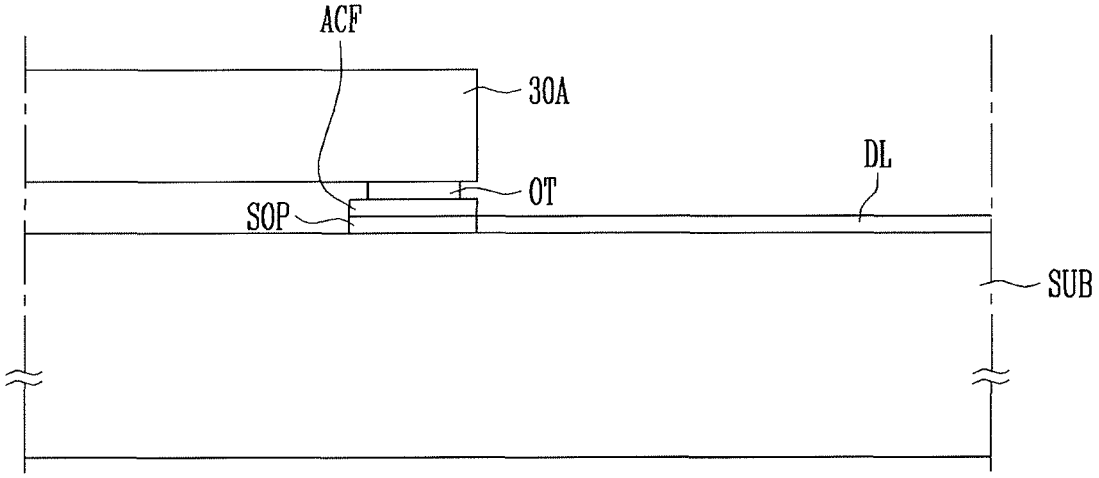
FIG. 4 illustrates an example of a connection between an output terminal of a first source drive IC and a source output pad.

FIG. 4 illustrates an embodiment of a connection between an output terminal of a first source drive IC and the source output pad of FIG. 2. Referring to FIG. 4, the data lines DL and the source output pads SOPs may be formed, for example, of the same metal on a lower substrate SUB of the display panel 10. An output terminal OT of the first source drive IC 30A may be formed to protrude from the first source drive IC 30A at an end of the first source drive IC 30A. The size of the output terminal OT of the first source drive IC 30A may be smaller than that of the source output pad SOP, as illustrated in FIG. 4.

In order to improve connecting force between the output terminal OT of the first source drive IC 30A and the source output pad SOP, an Anisotropic Conductive Film (ACF) may be attached between the output terminal OT of the first source drive IC 30A and the source output pad SOP. In another embodiment, the ACF may be omitted. A connection of the output terminal OT of the first source drive IC 30A and the test output pad TOP may be substantially the same as the connection of the output terminal OT of the first source drive IC 30A and the source output pad SOP.

Figure 5:
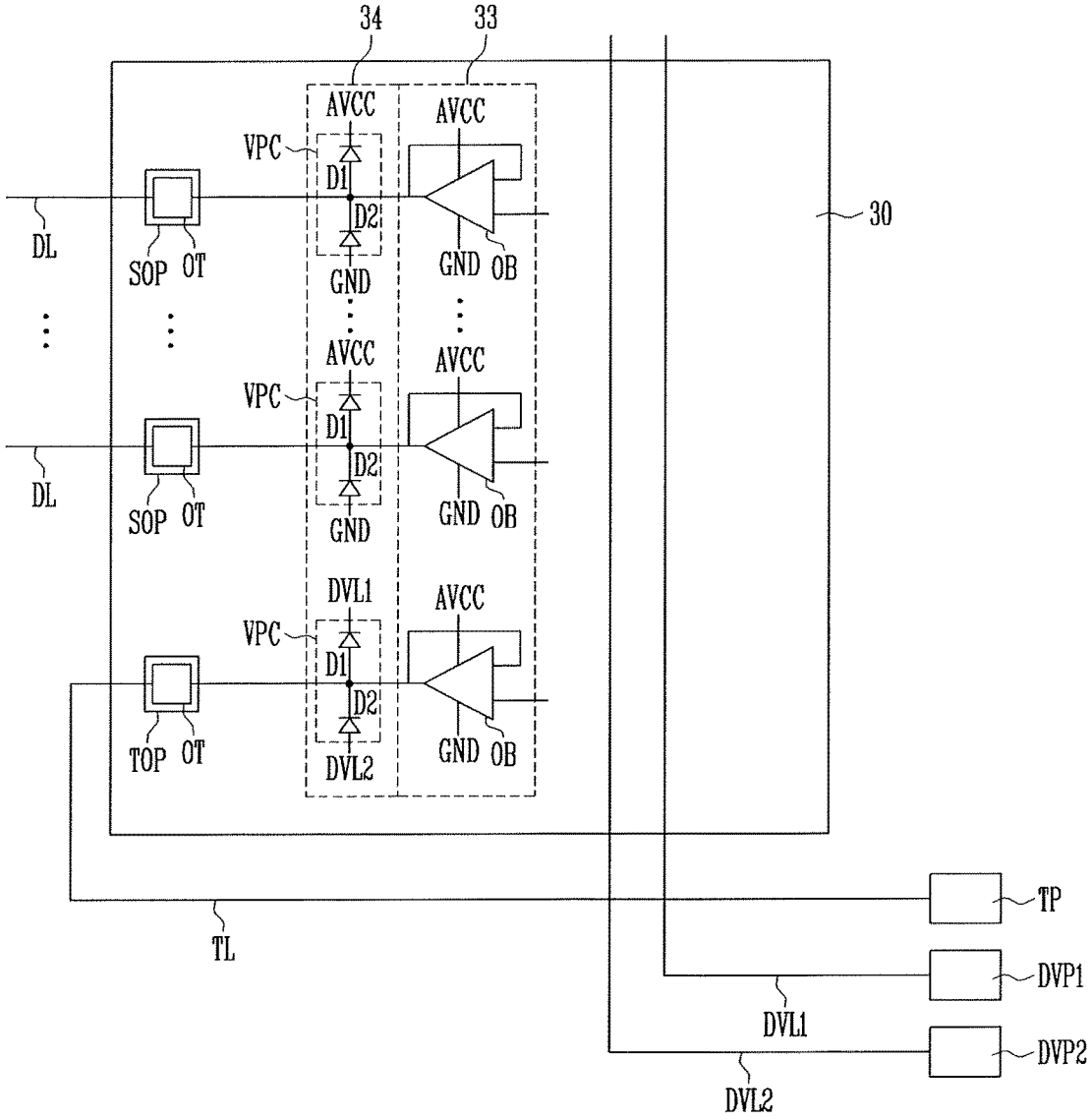
FIG. 5 illustrates an embodiment which includes voltage protection circuits connected between source output terminals and output buffers.

FIG. 5 illustrates an embodiment of voltage protection circuits connected between the source output terminals and output buffers of FIG. 3. Referring to FIG. 5, voltage protection circuits VPCs are connected between the source output terminals SOTs and output buffers OBs. Any one of the source output terminals is connected to the test output pad TOP. The remaining source output terminals are connected to the source output pads SOPs. The test output pad TOP is connected to the test pad TP through the test voltage line TL. The source output pads SOPs are connected to the data lines DLs.

Since the first driving voltage line DVL1 connected to the first driving voltage pad DVP1 and the second driving voltage line DVL2 connected to the second driving voltage pad DVP2 cross the first and second source drive ICs 30A and 30B, the first and second driving voltage lines DVL1 and DVL2 cross the test voltage line TL. Accordingly, a short-circuit defect may occur between any one of the first or second driving voltage lines DVL1 and DVL2 and the test voltage line TL. When such a defect occurs, the first and second driving voltages, supplied to the scan drivers 20A and 20B through the first and second riving voltage lines DVL1 and DVL2, may varied, or otherwise be adversely affected, by power voltages supplied to the voltage protection circuit VPC.

In order to prevent the problem, the first and second power voltages are supplied to the voltage protection circuit VPC connected between the output terminal OT and the output buffer OB, which are connected to the source output pad SOP. However, the first and second driving voltages are supplied to the voltage protection circuit VPC connected between the output terminal OT and the output buffer OB, which are connected to the test output pad TOP.

The first and second driving voltages are voltages supplied through the first and second driving voltage lines DVL1 and DVL2, and are different from the first and second power voltages. In this case, even when one or both of the first or second driving voltage lines DVL1 and DVL2 is short-circuited with the test voltage line TL, the first and second driving voltages are supplied to the voltage protection circuit VPC connected between the output terminal OT and the output buffer OB, which are connected to the test output pad TOP. As a result, the first and second driving voltages of the first and second driving voltage lines DVL1 and DVL2 are not varied or adversely affected.

For example, each of the voltage protection circuits VPCs includes first and second diodes D1 and D2. The first diode D1 of the voltage protection circuit VPC connected between the output terminal OT, which is connected to the source output pad SOP and the output buffer OB, is connected between a first power voltage source AVCC and the output terminal OT. The second diode D2 is connected between a second power voltage source GND and the output terminal OT.

For example, a cathode electrode of the first diode D1 of the voltage protection circuit VPC connected between the output terminal OT, which is connected to the source output pad SOP and the output buffer OB, is connected to the first power voltage source AVCC. An anode electrode of the first diode D1 is connected to the output terminal OT A cathode electrode of the second diode D2 is connected to the output terminal OT. An anode electrode of the second diode D2 is connected to the second power voltage source GND. The first power voltage supplied from the first power voltage source AVCC may be higher than the second power voltage from the second power voltage source GND.

The first diode D1 of the voltage protection circuit VPC connected between the output terminal OT, which is connected to the test output pad TOP and the output buffer OB, is connected between a first driving voltage line DVL1 and the output terminal OT. The second diode D2 is connected between a second driving voltage line DVL2 and the output terminal OT.

For example, a cathode electrode of the first diode D1 of the voltage protection circuit VPC connected between the output terminal OT, which is connected to the test output pad TOP and the output buffer OB, is connected to the first driving voltage line DVL1. An anode electrode of the first diode D1 is connected to the output terminal OT. A cathode electrode of the second diode D2 is connected to the output terminal OT. An anode electrode of the second diode D2 is connected to the second driving voltage lines DVL2. The first driving voltage supplied from the first driving voltage line DVL1 may be higher than that of the second driving voltage from the second driving voltage line DVL2.

Thus, even when the first driving voltage line DVL1 and the test voltage line TL are short-circuited, the first diode D1 of the voltage protection circuit VPC is connected to the first driving voltage line DVL1. As a result, the first driving voltage of the first driving voltage line DVL1 is not varied or adversely affected. Further, even when the second driving voltage line DVL2 and the test voltage line TL are short-circuited, the second diode D2 of the voltage protection circuit VPC is connected to the second driving voltage line DVL2. As a result, the second driving voltage of the second driving voltage line DVL2 is not varied or adversely affected.

Thus, even when either or both of the first or second driving voltage lines DVL1 and DVL2 is short-circuited with the test voltage line TL, the first and second driving voltages are supplied to the voltage protection circuit VPC connected between the output terminal OT, which is connected to the test output pad TOP and the output buffer OB. As a result, the first and second driving voltages of the first and second driving voltage lines DVL1 and DVL2 are not varied or otherwise adversely affected. As a result, in one embodiment, it is possible to stably supply the first and second driving voltages.

Figure 6:
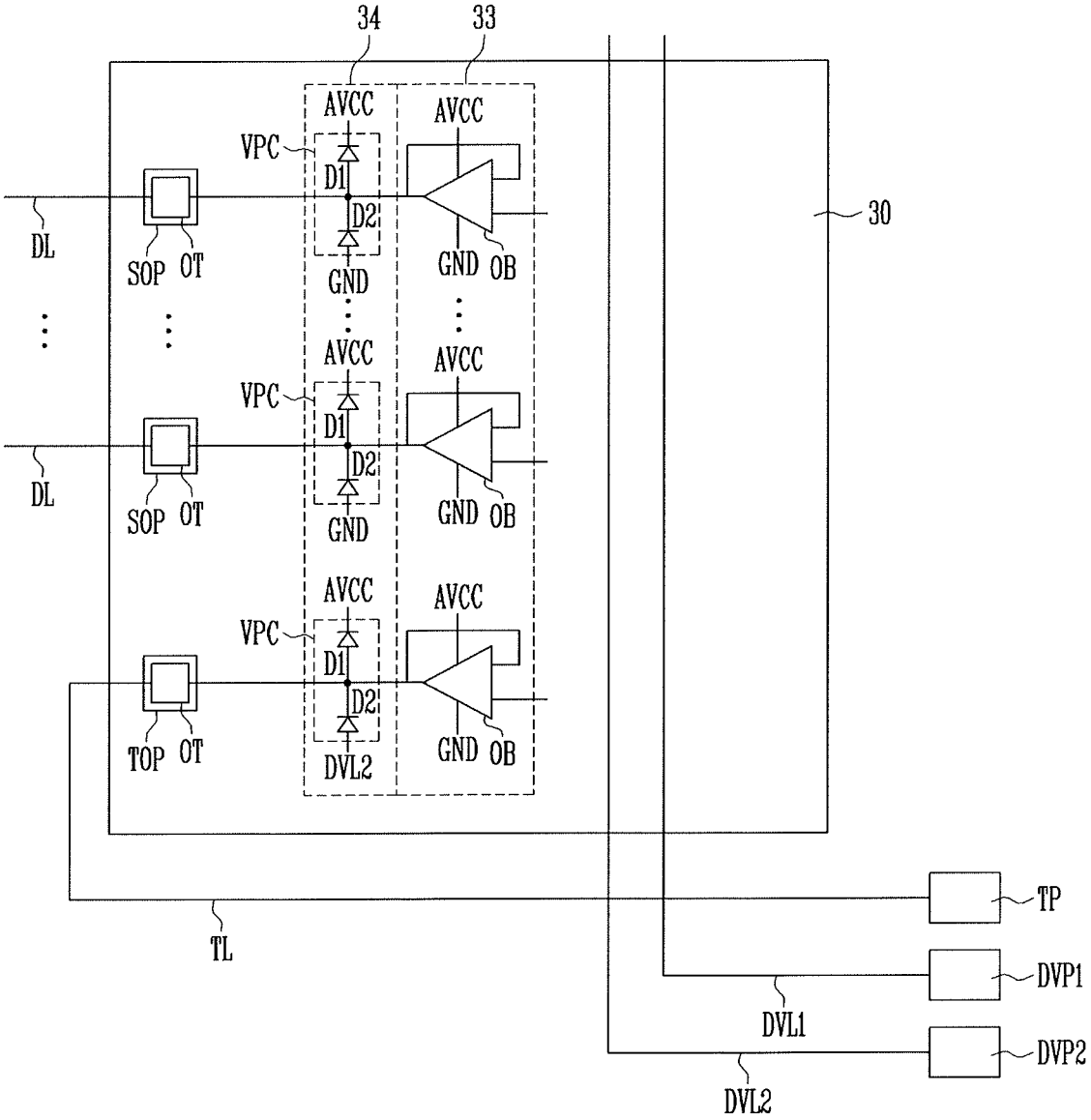
FIG. 6 illustrates another embodiment which includes voltage protection circuits connected between source output terminals and output buffers.

FIG. 6 illustrates another embodiment of voltage protection circuits connected between source output terminals and output buffers of FIG. 3. Source output terminals SOTs, output buffers OBs, a test output pad TOP, source output pads SOPs, a test voltage line TL, data lines DL, first and second driving voltage lines DVL1 and DVL2, and first and second driving voltage pads DVP1 and DVP2, which are illustrated in FIG. 6, may be substantially the same as those described with reference to FIG. 5.

Referring to FIG. 6, each of the voltage protection circuits VPCs includes first and second diodes D1 and D2. The first diode D1 of the voltage protection circuit VPC connected between the output terminal OT, which is connected to the source output pad SOP and the output buffer OB, is connected between a first power voltage source AVCC and the output terminal OT. The second diode D2 is connected between a second power voltage source GND and the output terminal OT.

For example, a cathode electrode of the first diode D1 of the voltage protection circuit VPC connected between the output terminal OT, which is connected to the source output pad SOP and the output buffer OB, is connected to the first power voltage source AVCC. An anode electrode of the first diode D1 is connected to the output terminal OT. A cathode electrode of the second diode D2 is connected to the output terminal OT, and an anode electrode of the second diode D2 is connected to the second power voltage source GND. The first power voltage supplied from the first power voltage source AVCC may be higher level than the second power voltage from the second power voltage source GND.

The first diode D1 of the voltage protection circuit VPC connected between the output terminal OT, which is connected to the test output pad TOP and the output buffer OB, is connected between the first power voltage source AVCC and the output terminal OT. The second diode D2 thereof is connected between the second driving voltage line DVL2 and the output terminal OT.

For example, a cathode electrode of the first diode D1 of the voltage protection circuit VPC connected between the output terminal OT, which is connected the test output pad TOP and the output buffer OB, is connected to the first power source AVCC. An anode electrode of the first diode D1 is connected to the output terminal OT. A cathode electrode of the second diode D2 is connected to the output terminal OT, and an anode electrode of the second diode D2 is connected to the second driving voltage lines DVL2. The first driving voltage from the first driving voltage line DVL1 may be higher than the second driving voltage supplied the second driving voltage line DVL2.

Thus, even when the second driving voltage line DVL2 and the test voltage line TL are short-circuited, the second diode D2 of the voltage protection circuit VPC is connected to the second driving voltage line DVL2. As a result, the second driving voltage of the second driving voltage line DVL2 is not varied or adversely affected.

When the second driving voltage line DVL2 and the test voltage line TL are short-circuited, the second driving voltage is supplied to the voltage protection circuit VPC connected between the output terminal OT which is connected to the test output pad TOP and the output buffer OB. As a result, the second driving voltage of the second driving voltage line DVL2 is not varied or otherwise adversely affected. As a result, in one embodiment, it is possible to stably supply the second driving voltage.

Figure 7:
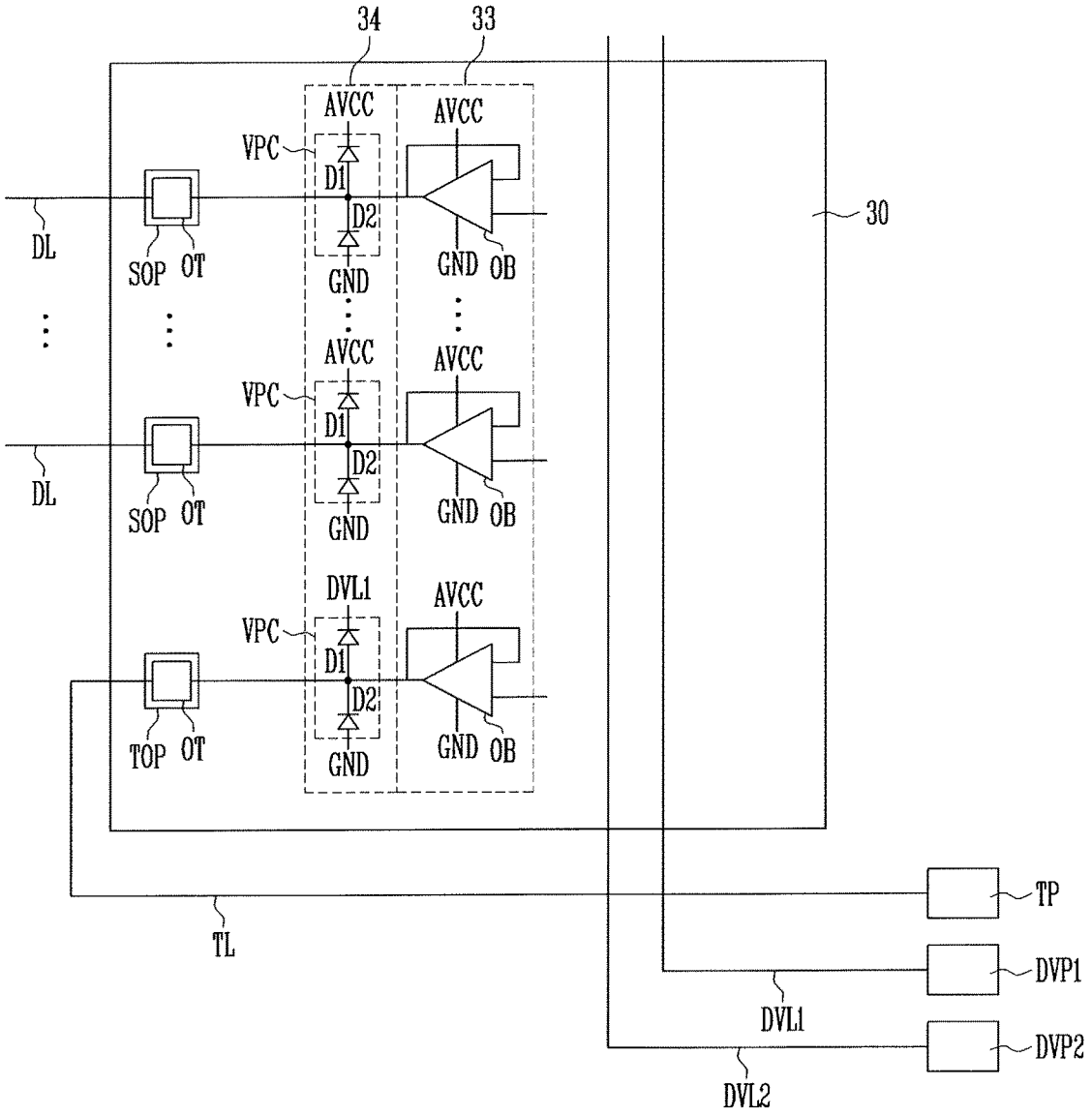
FIG. 7 illustrates another embodiment which includes voltage protection circuits connected between source output terminals and output buffers.

FIG. 7 illustrates another embodiment of voltage protection circuits connected between source output terminals and output buffers of FIG. 3. Source output terminals SOTs, output buffers OBs, a test output pad TOP, source output pads SOPs, a test voltage line TL, data lines DL, first and second driving voltage lines DVL1 and DVL2, and first and second driving voltage pads DVP1 and DVP2, which are illustrated in FIG. 7, may be substantially the same as those described with reference to FIG. 5.

Referring to FIG. 7, each of the voltage protection circuits VPCs includes first and second diodes D1 and D2. The first diode D1 of the voltage protection circuit VPC connected between the output terminal OT, which is connected to the source output pad SOP and the output buffer OB, is connected between a first power voltage source AVCC and the output terminal OT. The second diode D2 is connected between a second power voltage source GND and the output terminal OT.

For example, a cathode electrode of the first diode D1 of the voltage protection circuit VPC connected between the output terminal OT, which is connected to the source output pad SOP and the output buffer OB, is connected to the first power voltage source AVCC. An anode electrode of the first diode D1 is connected to the output terminal OT. A cathode electrode of the second diode D2 is connected to the output terminal OT, and an anode electrode of the second diode d2 is connected to the second power voltage source GND. The first power voltage supplied from the first power voltage source AVCC may be higher than the second power voltage from the second power voltage source GND.

The first diode D1 of the voltage protection circuit VPC connected between the output terminal OT, which is connected to the test output pad TOP and the output buffer OB, is connected between a first driving voltage line DVL1 and the output terminal OT. The second diode D2 is connected between a second power voltage source GND and the output terminal OT.

For example, a cathode electrode of the first diode D1 of the voltage protection circuit VPC connected between the output terminal OT, which is connected to the test output pad TOP and the output buffer OB, is connected to the first driving voltage line DVL1. An anode electrode of the first diode D1 is connected to the output terminal OT. A cathode electrode of the second diode D2 is connected to the output terminal OT, and an anode electrode of the second diode D1 is connected to the second power voltage source GND. The first driving voltage supplied from the first driving voltage line DVL1 may be higher than the second driving voltage from the second driving voltage line DVL2.

Thus, even when the first driving voltage line DVL1 and the test voltage line TL are short-circuited, the first diode D1 of the voltage protection circuit VPC is connected to the first driving voltage line DVL1. As a result, the first driving voltage of the first driving voltage line DVL1 is not varied or otherwise adversely affected. When the first driving voltage line DVL1 and the test voltage line TL are short-circuited, the first driving voltage is supplied to the voltage protection circuit VPC connected between the output terminal OT which is connected to the test output pad TOP and the output buffer OB. As a result, the first driving voltage of the first driving voltage line DVL1 is not varied or adversely affected. As a result, it is possible to stably supply the first driving voltage.

Figure 8:
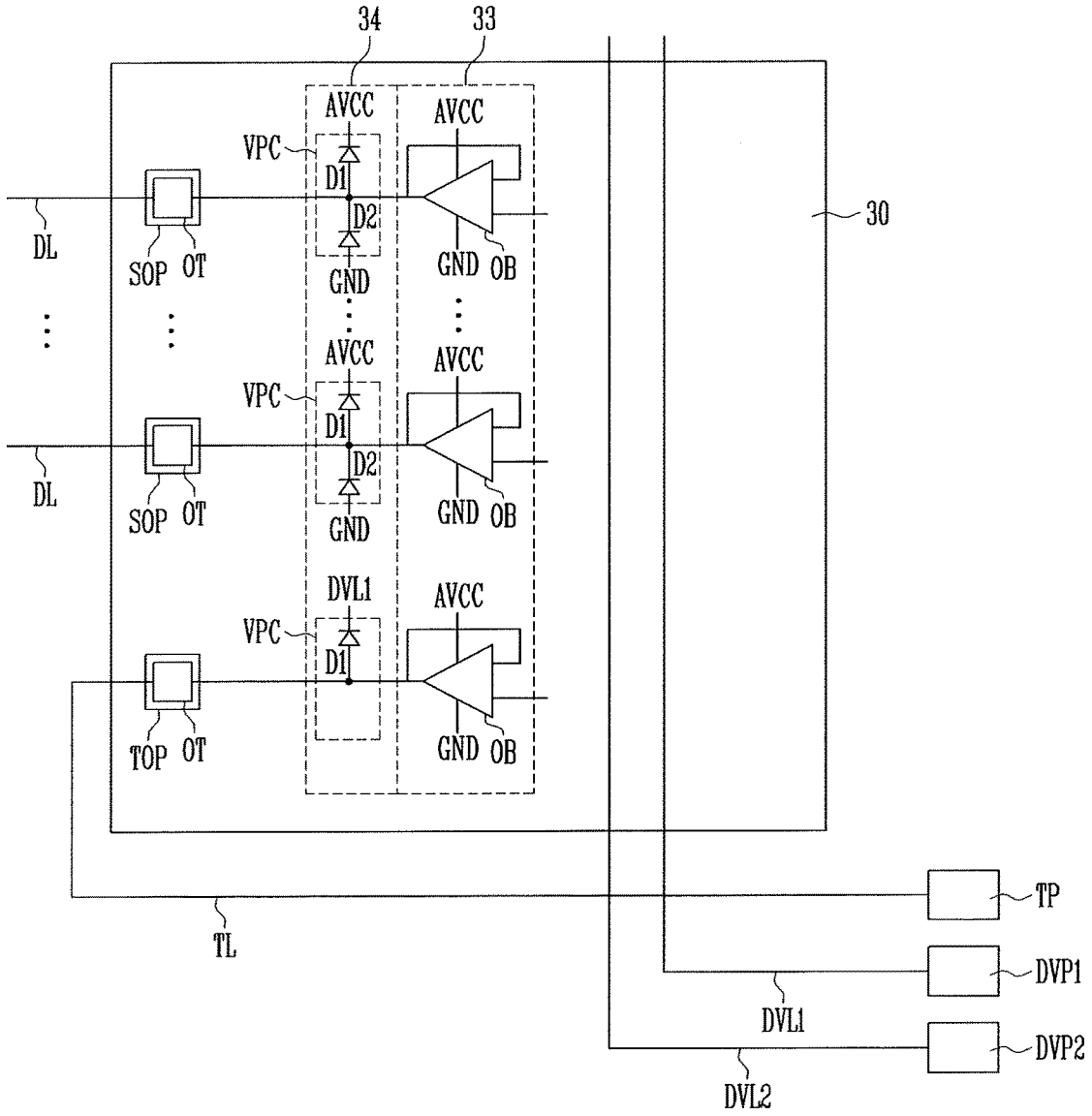
FIG. 8 illustrates another embodiment which includes voltage protection circuits connected between source output terminals and output buffers.

FIG. 8 illustrates another embodiment of voltage protection circuits connected between source output terminals and output buffers of FIG. 3. Source output terminals SOTs, output buffers OBs, a test output pad TOP, source output pads SOPs, a test voltage line TL, data lines DL, first and second driving voltage lines DVL1 and DVL2, and first and second driving voltage pads DVP1 and DVP2, which are illustrated in FIG. 8, may be substantially the same as those described with reference to FIG. 5.

Referring to FIG. 8, each of the voltage protection circuits VPCs connected between the output terminals OTs, which are connected to the source output pads SOPs and the output buffers OBs, includes first and second diodes D1 and D2. The first diode D1 of the voltage protection circuit VPC connected between the output terminal OT, which is connected to the source output pads SOP and the output buffer OB, is connected between a first power voltage source AVCC and the output terminal OT. The second diode D2 is connected between a second power voltage source GND and the output terminal OT.

For example, a cathode electrode of the first diode D1 of the voltage protection circuit VPC connected between the output terminal OT, which is connected to the source output pad SOP and the output buffer OB, is connected to the first power voltage source AVCC. An anode electrode of the first diode D1 is connected to the output terminal OT. A cathode electrode of the second diode D2 is connected to the output terminal OT, and an anode electrode of the second diode D2 is connected to the second power voltage source GND. The first power voltage supplied from the first power voltage source AVCC may be a voltage higher than the second power voltage from the second power voltage source GND.

The voltage protection circuit VPC connected between the output terminal OT, which is connected to the test output pad TOP and the output buffer OB, includes the first diode D1. The first diode D1 of the voltage protection circuit VPC connected between the output terminal OT, which is connected to the test output pad TOP and the output buffer OB, is connected between a first driving voltage line DVL1 and the output terminal OT.

For example, a cathode electrode of the first diode D1 of the voltage protection circuit VPC connected between the output terminal OT, which is connected to the test output pad TOP and the output buffer OB, may be connected to the first driving voltage line DVL1. An anode electrode of the first diode D1 may be connected to the output terminal OT. The first driving voltage supplied from the first driving voltage line DVL1 may have a voltage higher than the second driving voltage from the second driving voltage line DVL2.

Thus, even when the first driving voltage line DVL1 and the test voltage line TL are short-circuited, the first diode D1 of the voltage protection circuit VPC is connected to the first driving voltage line DVL1. As a result, the first driving voltage of the first driving voltage line DVL1 is not varied or otherwise adversely affected. When the first driving voltage line DVL1 and the test voltage line TL are short-circuited, the first driving voltage is supplied to the voltage protection circuit VPC connected between the output terminal OT which is connected to the test output pad TOP and the output buffer OB. As a result, the first driving voltage of the first driving voltage line DVL1 is not varied or otherwise adversely affected. As a result, it is possible to stably supply the first driving voltage.

Figure 9:
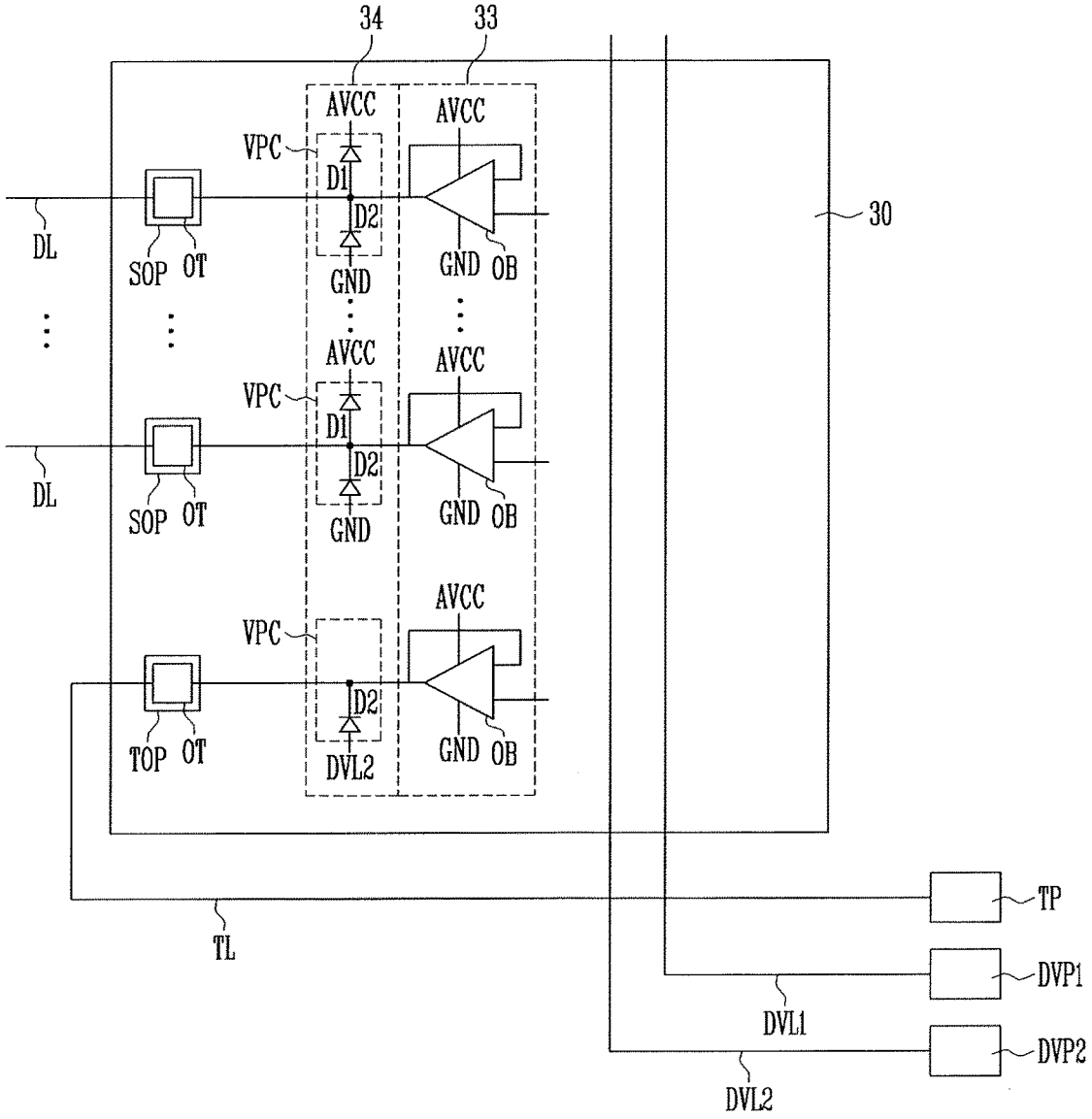
FIG. 9 illustrates another embodiment which includes voltage protection circuits connected between source output terminals and output buffers.

FIG. 9 illustrates another embodiment of voltage protection circuits connected between source output terminals and output buffers of FIG. 3. Source output terminals SOTs, output buffers OBs, a test output pad TOP, source output pads SOPs, a test voltage line TL, data lines DL, first and second driving voltage lines DVL1 and DVL2, and first and second driving voltage pads DVP1 and DVP2, which are illustrated in FIG. 9, may be substantially the same as those described with reference to FIG. 5.

Referring to FIG. 9, each of the voltage protection circuits VPC connected between the output terminals OTs, which are connected to the source output pads SOPs and the output buffers OBs, includes first and second diodes D1 and D2. The first diode D1 of the voltage protection circuit VPC connected between the output terminal OT, which is connected to the source output pad SOP and the output buffer OB, is connected between a first power voltage source AVCC and the output terminal OT. The second diode D2 is connected between a second power voltage source GND and the output terminal OT.

For example, a cathode electrode of the first diode D1 of the voltage protection circuit VPC connected between the output terminal OT, which is connected to the source output pad SOP and the output buffer OB, is connected to the first power voltage source AVCC. An anode electrode of the first diode D1 is connected to the output terminal OT. A cathode electrode of the second diode D2 is connected to the output terminal OT, and an anode electrode of the second diode D2 is connected to the second power voltage source GND. The first power voltage supplied from the first power voltage source AVCC may be a voltage higher than the second power voltage from the second power voltage source GND.

The voltage protection circuit VPC connected between the output terminal OT, which is connected to the test output pad TOP and the output buffer OB, includes the second diode D2. The second diode D2 of the voltage protection circuit VPC connected between the output terminal OT, which is connected to the test output pad TOP and the output buffer OB, is connected between the second driving voltage line DVL2 and the output terminal OT.

For example, a cathode electrode of the second diode D2 of the voltage protection circuit VPC connected between the output terminal OT which is connected to the test output pad TOP and the output buffer OB may be connected to the output terminal OT. An anode electrode of the second diode D2 may be connected to the second driving voltage line DVL2. The first driving voltage supplied from the first driving voltage line DVL1 may be a voltage higher than the second driving voltage from the second driving voltage line DVL2.

Thus, even when the second driving voltage line DVL2 and the test voltage line TL are short-circuited, the second diode D2 of the voltage protection circuit VPC is connected to the second driving voltage line DVL2. As a result, the second driving voltage of the second driving voltage line DVL2 is not varied or otherwise adversely affected. When the second driving voltage line DVL2 and the test voltage line TL are short-circuited, the second driving voltage is supplied to the voltage protection circuit VPC connected between the output terminal OT which is connected to the test output pad TOP and the output buffer OB. As a result, the second driving voltage of the second driving voltage line DVL2 is not varied or otherwise adversely affected. As a result, it is possible to stably supply the second driving voltage.

Figure 10:
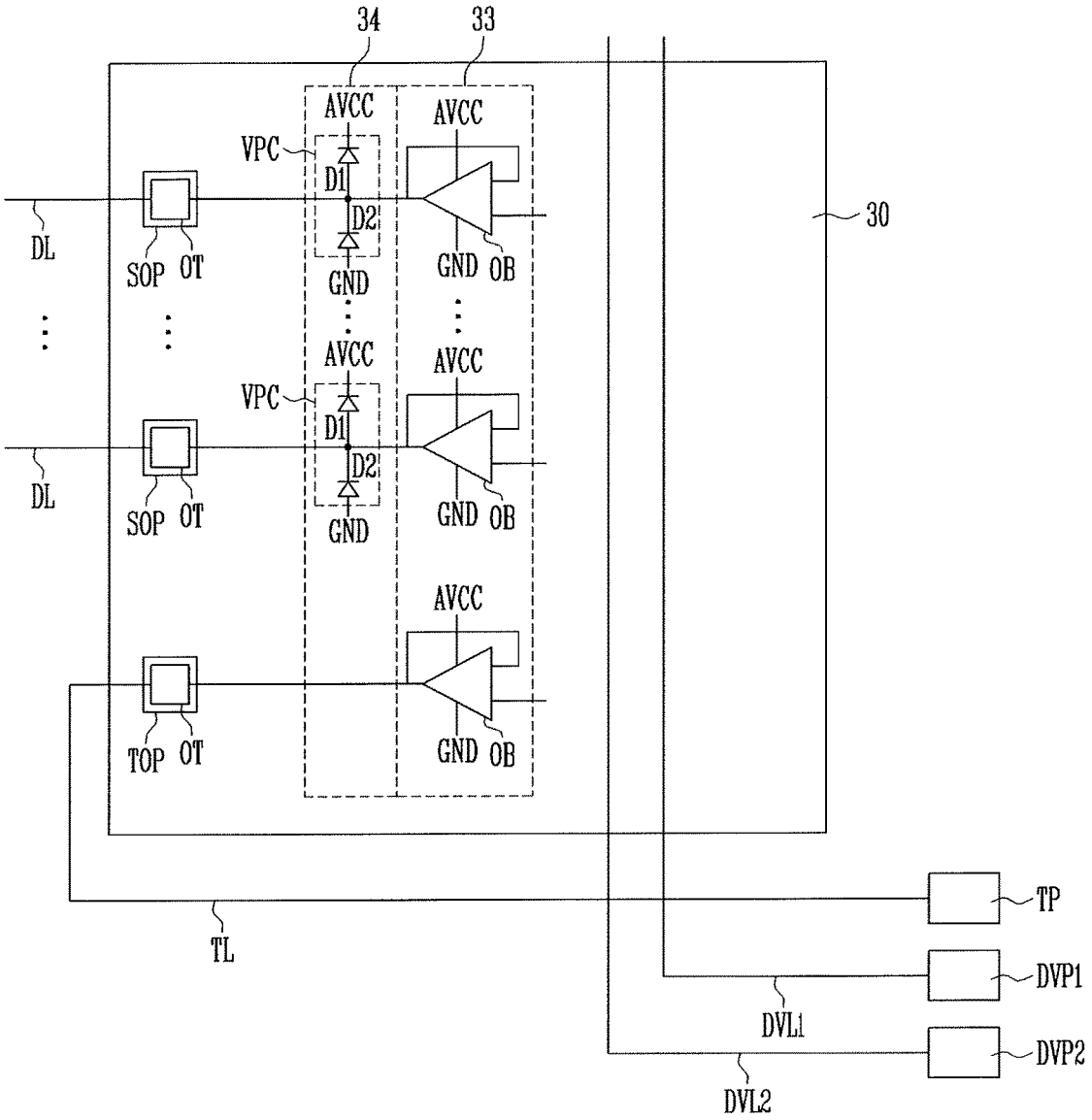
FIG. 10 illustrates another embodiment which includes voltage protection circuits connected between source output terminals and output buffers.

FIG. 10 illustrates another embodiment of voltage protection circuits connected between source output terminals and output buffers of FIG. 3. Source output terminals SOTs, output buffers OBs, a test output pad TOP, source output pads SOPs, a test voltage line TL, data lines DL, first and second driving voltage lines DVL1 and DVL2, and first and second driving voltage pads DVP1 and DVP2, which are illustrated in FIG. 10, may be substantially the same as those described with reference to FIG. 5.

Referring to FIG. 10, the voltage protection circuits VPCs are connected between the output terminals OTs which are connected to the source output pads SOPs and the output buffers OBs. The voltage protection circuit VPC is not connected between the output terminal OT which is connected to the test output pad TOP and the output buffer OB. Each of the voltage protection circuits VPCs includes first and second diodes D1 and D2. The first diode D1 of the voltage protection circuit VPC connected between the output terminal OT, which is connected to the source output pads SOP and the output buffer OB, is connected between a first power voltage source AVCC and the output terminal OT. The second diode D2 is connected between a second power voltage source GND and the output terminal OT.

For example, a cathode electrode of the first diode D1 of the voltage protection circuit VPC connected between the output terminal OT, which is connected to the source output pads SOP and the output buffer OB, is connected to the first power voltage source AVCC. An anode electrode of the first diode D1 is connected to the output terminal OT. A cathode electrode of the second diode D2 is connected to the output terminal OT, and an anode electrode of the second diode D2 is connected to the second power voltage source GND. The first power voltage supplied from the first power voltage source AVCC may be higher than the second power voltage from the second power voltage source GND.

Since the voltage protection circuit VPC is not connected between the output terminal OT which is connected to the test output pad TOP and the output buffer OB, even when any one of the first and second driving voltage lines DVL1 and DVL2 is short-circuited with the test voltage line TL, the first and second driving voltages are supplied to the voltage protection circuit VPC connected between the output terminal OT which is connected to the test output pad TOP and the output buffer OB. As a result, the first and second driving voltages of the first and second driving voltage lines DVL1 and DVL2 are not varied or otherwise adversely affected. As a result, it is possible to stably supply the first and second driving voltages.

Figure 11:
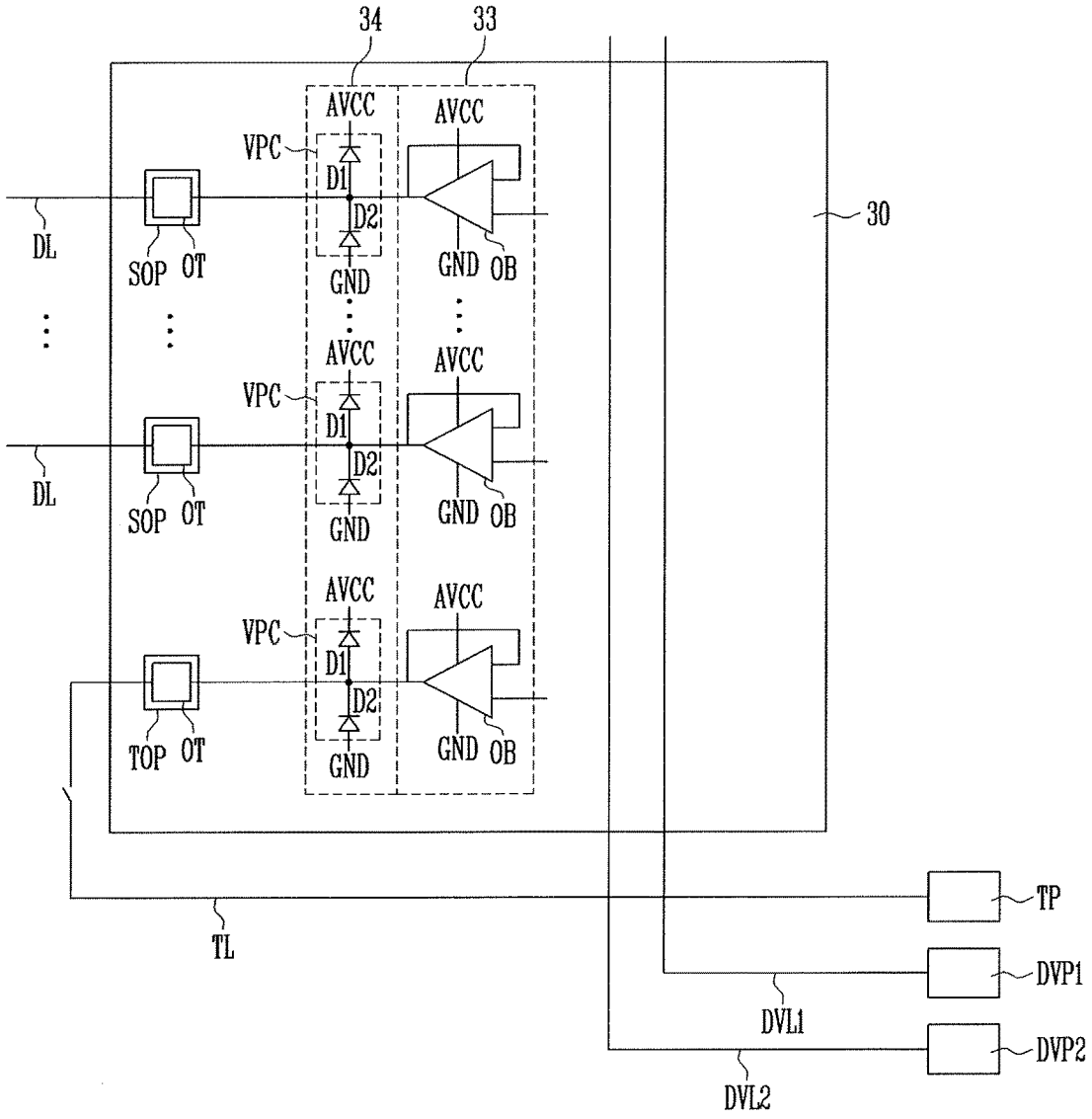
FIG. 11 illustrates another embodiment which includes voltage protection circuits connected between source output terminals and output buffers.

FIG. 11 illustrates another embodiment of voltage protection circuits connected between source output terminals and output buffers of FIG. 3. Source output terminals SOTs, output buffers OBs, a test output pad TOP, source output pads SOPs, a test voltage line TL, data lines DL, first and second driving voltage lines DVL1 and DVL2, and first and second driving voltage pads DVP1 and DVP2, which are illustrated in FIG. 11, may be substantially the same as those described with reference to FIG. 5.

Referring to FIG. 11, each of the voltage protection circuits VPCs includes first and second diodes D1 and D2.

The first diode of each of the voltage protection circuits VPCs is connected between the first power voltage source AVCC and the output terminal OT. The second diode D2 is connected between the second power voltage source GND and the output terminal OT. For example, a cathode electrode of the first diode D1 of each of the voltage protection circuits VPCs is connected to the first power voltage source AVCC. An anode electrode of the first diode D1 is connected to the output terminal OT. A cathode electrode of the second diode D2 is connected to the output terminal OT, and an anode electrode of the second diode D1 is connected to the second power voltage source GND. The first power voltage supplied from the first power voltage source AVCC may be higher than the second power voltage from the second power voltage source GND.

In one embodiment, the test voltage line TL may be disconnected at points where the test output pad TOP cross the first and second driving voltage lines DVL1 and DVL2. Accordingly, even when any one of the first or second driving voltage lines DVL1 and DVL2 is short-circuited, the first and second driving voltages of the first and second driving voltage lines DVL1 and DVL2 are not varied or otherwise adversely affected. As a result, it is possible to stably supply the first and second driving voltages.

Also, in one embodiment, in order to measure test voltages in a test process, test zigs may be connected to the test pads TPs. In this case, a disconnected part of the test voltage line TL may be connected, for example, through a laser process. As a result, the test voltage output from the test output pad TOP in the test process may be supplied to the test zig connected to the test pad TP through the test voltage line TL.

By way of summation and review, in accordance with one or more of the aforementioned embodiments, different voltages are supplied to the voltage protection circuit connected between the output terminal and the output buffer, which are connected to the test output pad, and the voltage protection circuit connected between the output terminal and the output buffer, which are connected to the source output pad. In one embodiment, the voltage protection circuit is not connected between the output terminal and the output buffer, which are connected to the test output pad. In one embodiment, the test voltage line connected to the test output pad is disconnected. As a result, when any one of the first or second driving voltage lines is short-circuited with the test voltage line, the first and second driving voltages of the first and second driving voltage lines are not varied or otherwise adversely affected, so that it is possible to stably supply the first and second driving voltages.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A source drive integrated circuit, comprising: a source driving circuit to generate data voltages according to a source timing control signal and digital video data; output buffers to output the data voltages from the source driving circuit to output terminals; and voltage protection circuits connected between the output buffers and the output terminals, wherein a power supply voltage supplied to at least one of the voltage protection circuits is different from a power supply voltage supplied to remaining ones of the voltage protection circuits for a single display panel.

2. The source drive integrated circuit as claimed in claim 1, wherein each of the voltage protection circuits includes first and second diodes.

3. The source drive integrated circuit as claimed in claim 2, wherein a power supply voltage supplied to the first diode of at least one of the voltage protection circuits is different from a power supply voltage supplied to the first diode of remaining ones of the voltage protection circuits.

4. The source drive integrated circuit as claimed in claim 2, wherein a power supply voltage supplied to the second diode of at least one of the voltage protection circuits is different from a power supply voltage supplied to the second diode of remaining ones of the voltage protection circuits.

5. The source drive integrated circuit as claimed in claim 1, wherein:

each of the remaining ones of the voltage protection circuits includes first and second diodes, and the at least one voltage protection circuit includes the first diode.

6. The source drive integrated circuit as claimed in claim 5, wherein:

a power supply voltage supplied to the first diode of at least one of the voltage protection circuits is different from a power supply voltage supplied to the first diode of remaining ones of the voltage protection circuits.

7. The source drive integrated circuit as claimed in claim 1, wherein:

each of the remaining voltage protection circuits include first and second diodes, and the at least one voltage protection circuits includes the second diode.

8. The source drive integrated circuit as claimed in claim 7, wherein:

a power supply voltage supplied to the second diode of at least one of the voltage protection circuits is different from a power supply voltage supplied to the second diode of the remaining ones of the voltage protection circuits.

9. A display device, comprising: a display panel including pixels at crossing regions of data lines and scan lines; one or more source drive Integrated Circuits (ICs) to supply data voltages to the data lines; and a scan driving circuit to supply scan signals to the scan lines, wherein the source drive IC includes: a source driving circuit to generate data voltages according to a source timing control signal and digital video data; output buffers to output the data voltages from the source driving circuit to output terminals; and voltage protection circuits connected between the output buffers and the output terminals, and a power supply voltage supplied to at least one of the voltage protection circuits is different from a power supply voltage supplied to remaining ones of the voltage protection circuits for a single display panel.

10. The display device as claimed in claim 9, wherein each of the voltage protection circuits includes first and second diodes.

11. The display device as claimed in claim 10, wherein a power supply voltage supplied to the first diode of at least one of the voltage protection circuits is different from a power supply voltage supplied to the first diode of remaining ones of the voltage protection circuits.

12. The display device as claimed in claim 10, wherein a power supply voltage supplied to the second diode of at least one of the voltage protection circuits is different from a power supply voltage supplied to the second diode of remaining ones of the voltage protection circuits.

13. The display device as claimed in claim 9, wherein:

each of the remaining ones of the voltage protection circuits includes first and second diodes, and the at least one voltage protection circuit includes the first diode.

14. The display device as claimed in claim 13, wherein:

a power supply voltage supplied to the first diode of at least one of the voltage protection circuits is different from a power supply voltage supplied to the first diode of the remaining ones of the voltage protection circuits.

15. The display device as claimed in claim 9, wherein:

each of the remaining ones of the voltage protection circuits includes first and second diodes, and the at least one of the voltage protection circuits includes the second diode.

16. The display device as claimed in claim 15, wherein:

a power supply voltage supplied to the second diode of at least one of the voltage protection circuits is different from a power supply voltage supplied to the second diode of the remaining ones of the voltage protection circuits.

17. The display device as claimed in claim 9, wherein the display panel includes:

driving voltage pads, a test pad, and a test output pad;

driving voltage lines to connect the driving voltage pads and the scan driver; and a test voltage line to connect the test pad and the test output pad, wherein the driving voltage lines and the test voltage line cross each other.

18. The display device as claimed in claim 17, wherein the source drive IC is on the driving voltage lines.

19. The display device as claimed in claim 18, wherein the source drive IC is attached to the display panel by a chip-on-glass connection or a chip-on-plastic connection.

20. The display device as claimed in claim 17, wherein the display panel includes:

signal supply pads;

source input pads connected to input terminals of the source drive IC;

signal input supply lines to connect the source input pads and the signal supply pads; and source output pads connected to output terminals of the source drive IC, and connected to the data lines.

* * * * *